US007172084B1

(12) United States Patent
Williams et al.

(10) Patent No.: US 7,172,084 B1
(45) Date of Patent: Feb. 6, 2007

(54) FEED BOTTLES FOR BABIES

(76) Inventors: Stephen James Williams, 16 Vancouver Drive, Blackwood, Gwent NP2 0UA (GB); Christopher Mallet, 61a Clifton Hill, St. John's Wood London NW8 0JN (GB)

( * ) Notice: Subject to any disclaimer, the term of this patent is extended or adjusted under 35 U.S.C. 154(b) by 0 days.

(21) Appl. No.: 09/622,650

(22) PCT Filed: Feb. 18, 1999

(86) PCT No.: PCT/GB99/00499

§ 371 (c)(1),
(2), (4) Date: Jan. 18, 2001

(87) PCT Pub. No.: WO99/42074

PCT Pub. Date: Aug. 26, 1999

(30) Foreign Application Priority Data

Feb. 21, 1998 (GB) ..... 9803620.5
Aug. 29, 1998 (GB) ..... 9818851.9

(51) Int. Cl.
*A61J 9/00* (2006.01)

(52) U.S. Cl. ..... 215/11.1; 215/11.6

(58) Field of Classification Search ..... 215/11.1, 215/11.5, 330, 11.4, 11.6; 606/234, 235, 606/236

See application file for complete search history.

(56) References Cited

U.S. PATENT DOCUMENTS 2,599,630 A * 6/1952 Hair ..... 215/11.4
3,549,031 A 12/1970 Ritsi
4,053,648 A * 10/1977 Schmid et al. ..... 426/117
4,345,691 A * 8/1982 Burke ..... 215/216
4,623,068 A 11/1986 Brown et al.
4,676,386 A 6/1987 Phlaphongphanich
5,143,237 A * 9/1992 Lindsey et al. ..... 215/330
5,316,160 A * 5/1994 Cautereels ..... 215/11.1
6,016,929 A * 1/2000 Williams ..... 215/11.1
6,401,949 B1 * 6/2002 Lyle et al. ..... 215/11.4

FOREIGN PATENT DOCUMENTS

DE 2358128 B 1/1975

(Continued)

*Primary Examiner*—Lien M. Ngo
(74) *Attorney, Agent, or Firm*—Bryan Cave, LLP

(57) ABSTRACT

A feed and drink bottle is made of plastic material preferably by an aseptic process. In its base form the bottle has a mouth intended to be sealed with a closure put in place after the feed has been put in the bottle through its mouth. The bottle is rendered unfit for re-use as a baby's bottle, thus making it disposable either by preventing the closure from being able to be removed from the body of the bottle once it has reached its fully engaged position, or by preventing it from being replaced in a fluid tight position once it has been removed. The closure has a teat secured to it in an irremovable matter, as by the teat being clamped between the closure and a retainer member held in place in the closure, or by the teat being bonded to the closure. When the closure and teat are formed as a single unit, the unit may be used more than once on a body of aseptic plastic material, thus putting back on the user the responsibility of ensuring that the body is sterile or aseptic before such re-use.

3 Claims, 7 Drawing Sheets

FOREIGN PATENT DOCUMENTS

| | | | | |
|---|---|---|---|---|
| DE | 3309390 | * 11/1984 | ..... | 215/11.1 |
| EP | 0300786 A | 1/1989 | | |
| EP | 0585818 A | 3/1994 | | |
| EP | 0819417 A | 1/1998 | | |
| FR | 2134720 A | 12/1972 | | |
| WO | WO 86/06273 | * 11/1986 | ..... | 215/11.1 |

* cited by examiner

FEED BOTTLES FOR BABIES

This invention relates to feed and drink bottles for babies and in particular to such bottles as are made from plastics material by an aseptic injection-moulding process.

Feed bottles for babies generally comprise a container for the milk or other nutrient liquid (feed); a (natural or synthetic) rubber teat for the mouth of the container, and a screw-threaded cap to fit on the mouth to retain the teat in position. To ensure that a baby's feed is not contaminated, it is usual to sterilise the bottle before use, as by cleaning the bottle in a sterilising liquid or using a steam steriliser. The same needs to be done with the teat and the cap of the bottle, to ensure their sterility. However, sterilisation, or even thorough cleaning of a baby's bottle, may be over looked, or carried out inadequately, causing the feed to become contaminated.

DE 2358128B discloses a bottle closure device and a complementarily formed bottle top for the sterile dispensing of flowable and/or pasty or viscous, sterile bottle contents, particularly of baby food, whereby the bottle top or its opening provided for the discharge of the contents, respectively, is covered under sterile conditions by a cover or closure wall, and said device being adapted to be attached to said bottle top and including on its inner face cutting means for the opening of said bottle, threads for threading onto the bottle top provided with complementary threads and for the simultaneous actuation of said cutting means, as well as means for the sterile dispensing or removal of the bottle contents after the opening of said bottle.

EP 0300786A discloses a one-piece combined feeding teat and cap assembly in which the mouthpiece is moulded from a flexible material such as thermoplastic rubber and attached to the cap which is moulded from a different rigid material such as polypropylene. The cap can either make a snap fit or a screw fit onto a container. A method of manufacturing the one-piece combined feeding teat and cap of the invention is also disclosed.

According to one aspect of the present invention, there is provided disposable, preferably aseptic, bottles intended for a single-use only. This is achieved by ensuring that the closure of the bottle cannot be removed once it has been fitted fully in place. One such method of doing this is disclosed in EP-A-0819417, which shows a wide-mouthed bottle body having a closure snap-fitted to it, the closure nipping the periphery of a wide flange on a teat between itself and the mouth of the body. After it has been fitted, the closure cannot be removed because a curved flange on the closure denies the user access to the rim of the closure.

This known bottle suffers from serious disadvantages. One is that the bottle cannot be manufactured by known techniques, because of the reentrant angles in both the body and the flange. Even were this difficulty to be overcome, another disadvantage is that the complicated construction of the bottle would make it extremely expensive to manufacture, thus militating against users being prepared to pay so much for a single use bottle. Another disadvantage arises from the fact that the closure has to be pushed home by the user. It is inevitable that a flustered mother would sometimes push only part of the closure rim over the latching shoulder over the latching shoulder on the body, leaving the rest of the closure canted at a slight angle, which would prevent the bottle from being fluid-tight. She could be misled by the noise into thinking the closure was fully home, when only part of it was. This known 'theoretical' invention also is potentially dangerous to the baby, because a baby could pull the end of the teat so hard that its flange ceases to be clamped between the closure and the body, enabling the baby to pull the teat out of the bottle converting the teat into a potentially-lethal object which could suffocate the baby by becoming lodged in its windpipe. In addition, it may be possible with this bottle for the baby to deform the bottle immediately below the closure to an extent such that the fluid seal between the body and closure is broken, leading to a leakage of the liquid from the bottle which could prove dangerous to a feeding infant.

The present invention overcomes these disadvantages by providing a screw-threaded connection between the closure and the body, thus ensuring that the closure remains parallel to the plane of the mouth of the body as it is being screwed into its latched position. In addition, the body is in the shape of a simple beaker which enables it to be made at high volumes by an injection-moulding machine under aseptic conditions. The teat is clamped irremovably to the closure by means of a retainer disc. The body does not come into contact with the teat, thus permitting the flange of the teat to be considerably smaller in area than the mouth of the body, thus economising in the use of the relatively-expensive material from which the teat is made.

According to another aspect of the invention, the teat is bonded to the closure in a manner which does not rely on the use of a retainer disc, so that the two become an integral unit. While such a unit may become coupled to a bottle body in an irremovable manner, it is within the purview of this invention for the one-way latching to be omitted, permitting the closure unit to be used more than once on a body containing liquid feed.

According to yet another aspect, the invention provides a feed bottle of which the body is formed with an integral teat, while access to the interior of the body is provided at an open end remote from the teat. The open end is intended to be closed after filling, in either a removable or irremovable manner, depending on the nature of the coupling between the end of the body and a cap movable between a remote position giving access to the open end, and a closed position providing a fluid-tight coupling with the body.

According to a yet further aspect, the invention provides a feed bottle of which the major components are made of plastics materials by an aseptic process, the bottle including: a body for holding a quantity of milk or other liquid, the body having a teat of plastics material permanently secured to it, or integral with it, and an open end at a location remote from the teat, the open end being intended to be sealed in a fluid-tight manner by means of a cap, the coupling between the cap and body being such that the coupling has to be broken to permit the cap to be removed from the body, the breakage ensuring that the cap is not again able to achieve a fluid-tight fit with the body.

Accordingly the present invention provides a feed bottle which is as claimed in the appended respective claims.

The present invention will now be described by way of example with reference to the accompanying drawings, in which:

FIG. 6 is another view, similar to FIG. 4, of another embodiment, in which a retainer disc has been dispensed with;

In the following description of the drawings, components which are similar in different Figs. retain their original references.

Figure 1:
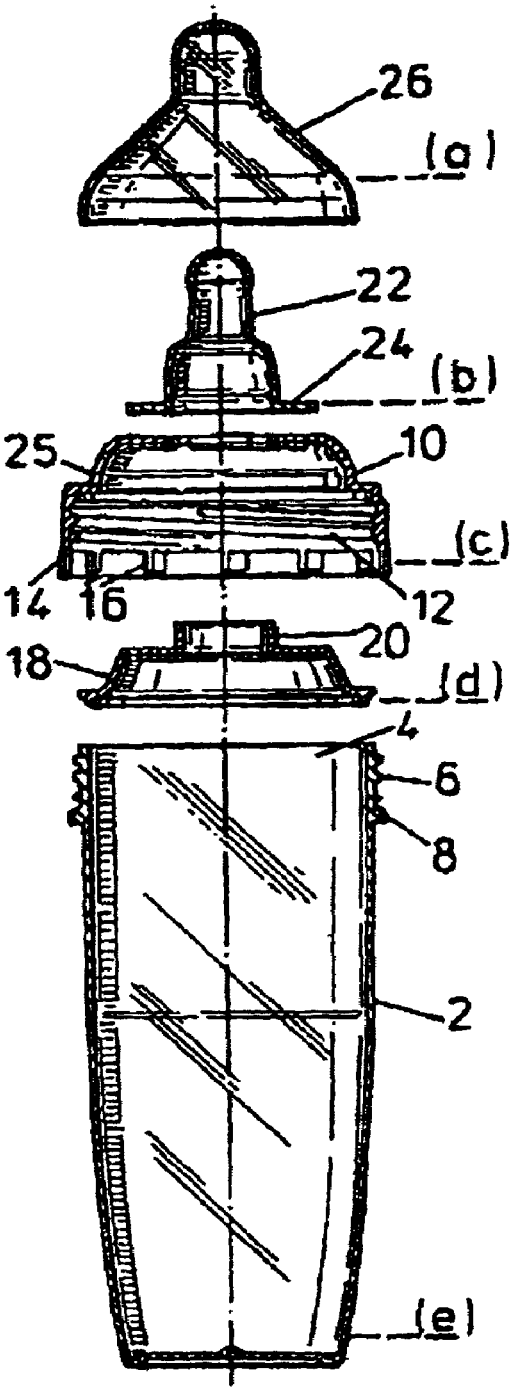
FIG. 1 is an exploded side elevation of one embodiment of the invention, of which the component parts shown in FIG. 1(*a*)–(*e*) are in section.
Figure 2:
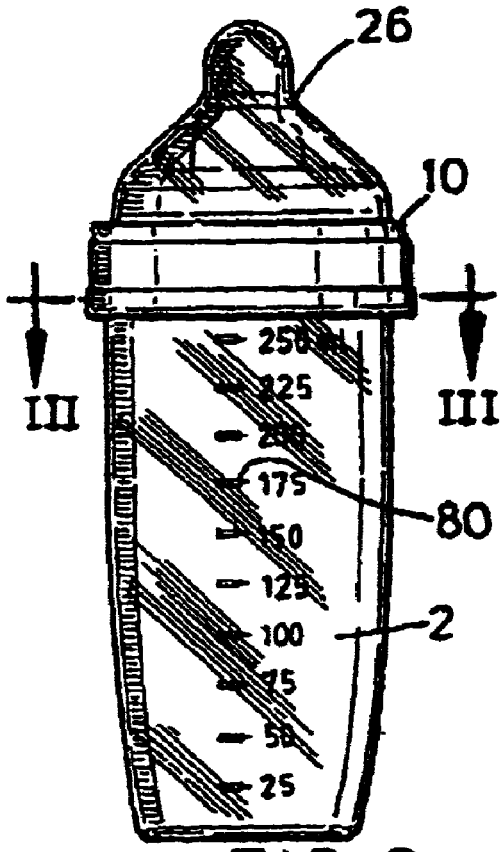
FIG. 2 is a side elevation of the bottle shown in FIG. 1 when assembled, with volume graduations applied to the side of its body.
Figure 1A:
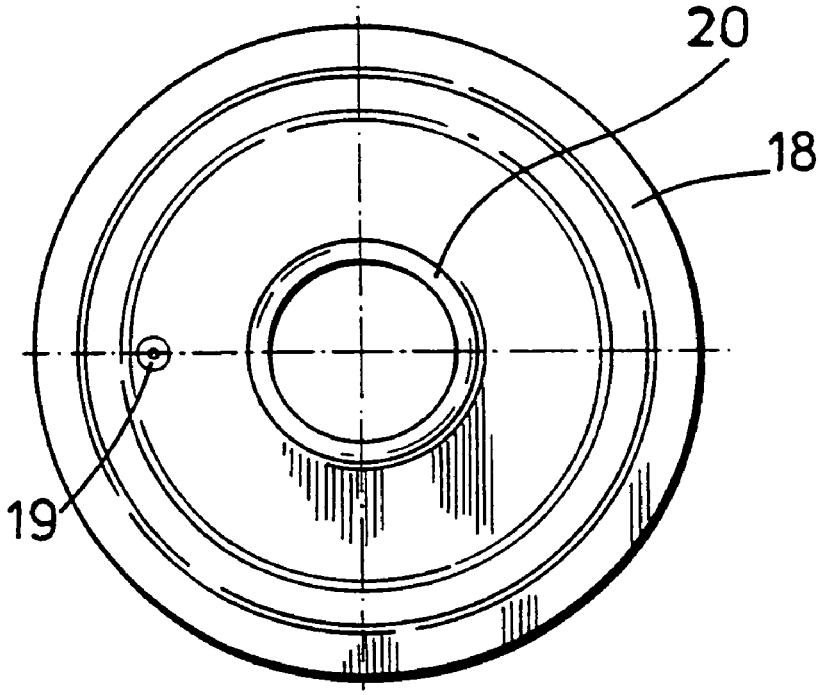
FIGS. 1A and 1B show a variant on FIG. 1.
Figure 1B:
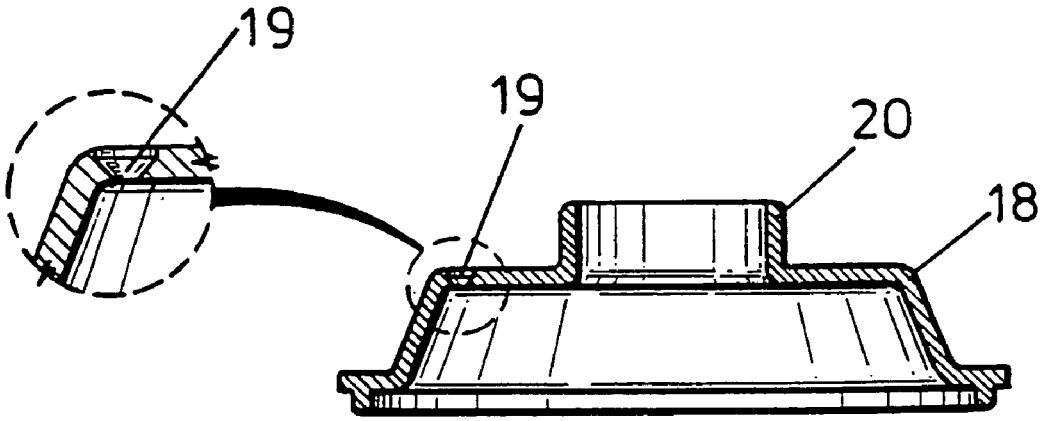

The bottle shown in FIGS. 1 and 2 comprises basically a body 2 acting as the container of the liquid feed. At its upper end (as viewed), the wide mouth 4 of the body is formed with screw-threads 6 and with a projecting annulus of ratchet teeth 8. Intended to cooperate with the threads 6 is a closure 10 having its inner surfaces formed with complementary screw-thread 42 and having an extended skirt 14 with an annular series of complementary ratchet teeth 16, to be described in more detail below. Intended to be clamped between the closure and the body is a retainer disc 18 having a hollow stub 20 projecting from it. A teat 22 for the bottle has an end flange 24, the diameter of the annular flange being significantly smaller than the inner diameter of the mouth 4. The inner diameter of the opening in the teat is an elastic fit on the stub 20. Designed to clip over a shoulder 25 on the closure 10 is a teat shield 26. In FIGS. 1A and B the retainer disc 18 is provided with a vent hole 19 at a shoulder of the disc. The vent hole allows pressure equalisation either side of the teat, i.e. inside and outside. The hole vents back into the bottle and an infant sucking on the teat can keep the seal around the teat. A feeding infant does not have to remove its lips/mouth from the teat to equalise the air pressure to gain further liquid flow. Consequently, the bottle becomes anti-colic. As infants breathe through their nostrils during feeding because of the pressure equalisation facility the infant is less likely to swallow feed down the wrong way.

Figure 3:
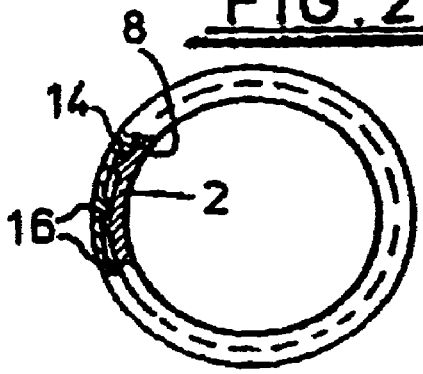
FIG. 3 is a section of the line III—III of FIG. 2, showing one embodiment of irreversible coupling between the body and closure.

FIG. 3 shows the two annular series of interengaging teeth on the body 2 and the cap 10. As can be seen from it, both series of teeth 8 and 16 are in the form of ratchet teeth, with each tooth having a radial face and an oblique face. The angle of obliquity is determined by the nature of the material from which both the cap and the body are made. As can be seen from FIG. 1, the cap 10 has at its centre an opening which is a close fit on the other part of the teat adjacent to the flange 24.

In order to arrive at the assembled bottle shown in FIG. 2, the teat 22, is first pushed into place in closure 10. Thereafter the disc 18 is positioned inside the closure 10, with the stub being embraced by the inner surfaces of the flange 24 and the adjacent surface of the teat. After the body 2 has been charged with the necessary volume of feed, the closure is then screwed on to the body. During this movement, the teeth 16 on the closure do not touch the threads 6. Towards the end of the screwing action, the teeth on the closure 16 and body 8 come into contact with each other, and their oblique faces slide on each other, such movement being permitted by the elastic nature of the materials of which the closure and body are made. This 'double ratchet' construction ensures that, while the closure may move relatively to the body in the screwing-on direction, it is impossible for the closure to be unscrewed from the body, so that, once assembled (which happens after the feed has been put in the bottle), the closure cannot be removed from the body. This ensures that the bottle cannot be reused as a feed bottle, so that it is a 'single-use' (or 'disposable') bottle.

It is a feature of this invention that all the components of the bottle are made of plastics materials which may be made into the components of the bottle by an aseptic process, so that the products do not need post-sterilisation, but can be packed as manufactured. With all interior surfaces of the bottle, and both interior and exterior surfaces of the teat, being aseptic, the user need do nothing but ensure that the feed is sterile before putting it in the bottle and closing it by means of the closure.

Amongst the materials which can be used for the body, retainer disc and closure are polypropylene and polyethylene. A suitable material for the teat itself, and one which is more expensive than the others, is a thermoplastic elastomer, such as that sold under the trade name KRATON. Not all teat materials lend themselves to being made by an aseptic process, in which case the teats have to be pre-sterilised before being positioned in the closure. After manufacture and assembly (in those versions which comprise separate components, not necessarily of the same plastics material) the bottle, if it is not aseptic as made, may be rendered sterile by means of irradiating it with ultra-violet or infrared radiation, with x-rays, gamma rays or an electron beam, subject to the plastics materials not being degraded as a result.

In the bottle of FIGS. 1–3, the disc 18 prevents the teat from being pulled out from its position between the closure and the disc. In addition, introversion of the teat, as by the finger of a baby, also cannot bring about separation of the teat from the closure. This fit can be enhanced by designing the disc so that its periphery is clamped between the closure and the rim of the body. The presence in the final bottle of the disc gives such stiffness to the closure that determined pressure inwardly on the body immediately below the skirt 14 is unable to distort the body sufficiently for it to come away from the interior of the closure by a distance enough to allow air into the bottle, or feed to leak from it. Thus, under all foreseen conditions of use, neither the baby nor its carer is able to regain access to the bottle once it has been latched in position; to remove the teat therefrom, or to cause the bottle to lose it fluid-tightness.

Figure 4:
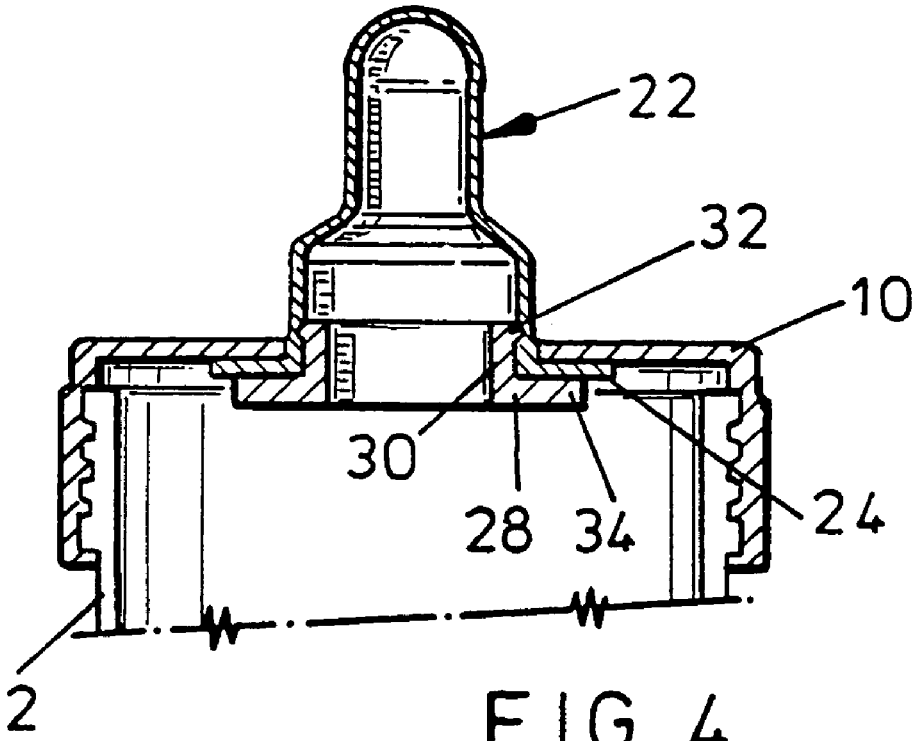
FIG. 4 is a sectional view of the upper part of another feed bottle of this invention.

In that form of the invention shown in FIG. 4, the teat 22 is held irremovably on the cap 10 by means of a retainer ring 28. The ring is shaped so that it is able to clamp the flange 24 of the teat between itself and the closure. Its axially-directed cylindrical part 30 is formed at its free end with an outer lip or bead 32. The spacing of this lip from the radial flange 34 of the ring is related to the thickness of the flange 24 of the teat so that, when the ring has been pushed in to the mouth of the teat, the lip forces the material of the teat to deform slightly so that the teat embraces the rim of the opening in the closure 10. In this embodiment, and in many other embodiments, of this invention, the closure and body can have the cooperating sets of ratchet teeth to ensure that, once tightened, the closure cannot be removed from the body by unscrewing, although these teeth are not clearly shown in the drawings, for clarity.

Figure 5:
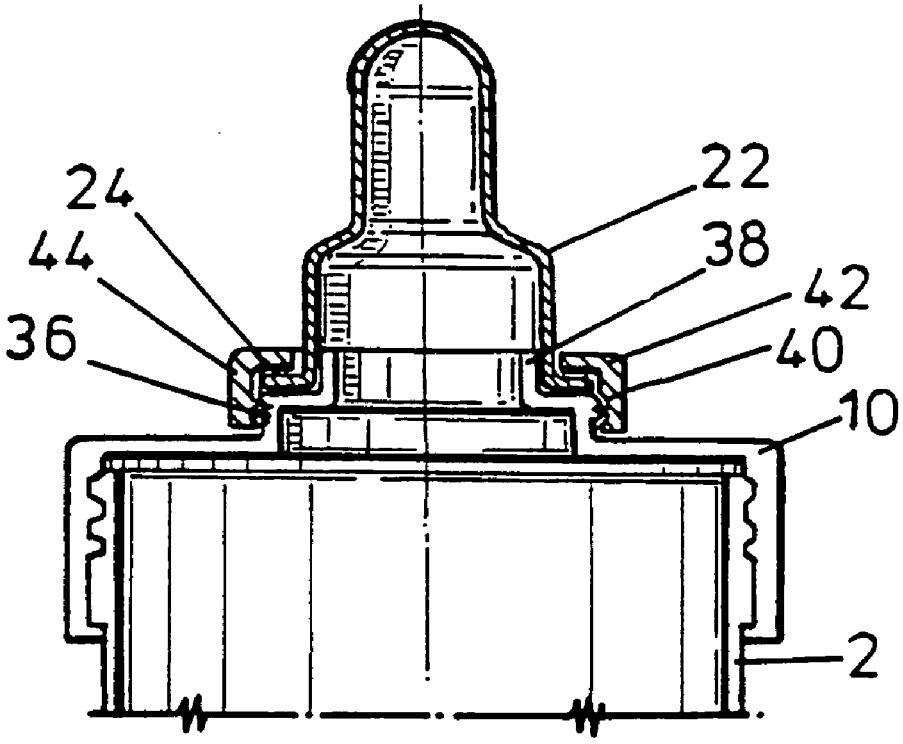
FIG. 5 is a view, similar to FIG. 4, of another embodiment of the invention.

In the FIG. 5 embodiment, the closure 10 is formed with two stepped flanges 36 and 38. The outer cylindrical surface of flange 36 is formed with screw-threads 40. Intended to engage the threads 40 is a lock ring 42, having an inwardly-directed flange 44 and a complementary set of internal screw-threads. When the lock ring is screwed into position on flange 36, it clamps flange 24 of teat 22 between itself and the shoulder of the closure between the two flanges. Although not shown in the drawing, the ring 42 is movable relatively to the screw-threads 40 in only the tightening direction, so that it too is not removable from its clamping engagement on the teat.

Figure 6:
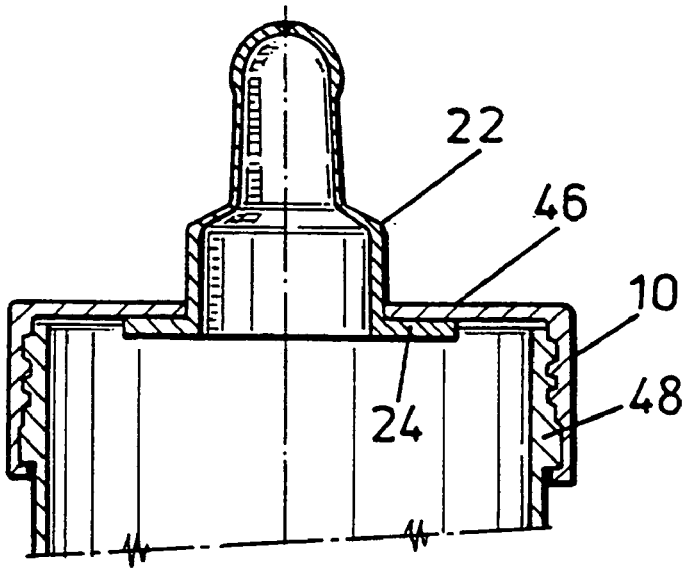

In the FIG. 6 version of the invention, the retainer disc is dispensed with. Instead, the teat 22 is made integrally with the closure by a two-step ('two-shot') manufacturing process, by which the contacting surfaces of the teat flange 24 and end wall 46 of the closure become bonded together. This bond ensures the safety of the bottle, while its fluid-tightness is ensured by the fit between the closure and body. In the FIG. 6 embodiment, the mouth of the body may be stiffened, by forming a thick ring 48 of plastics material which resists inwards displacement of the body relative to the skirt of the closure.

Figure 7:
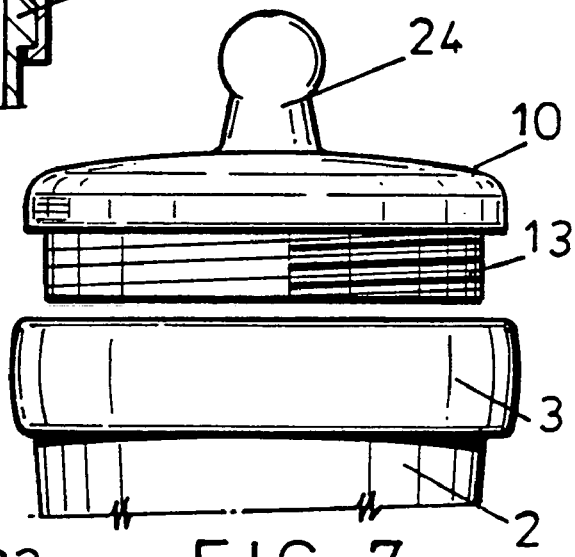
FIG. 7 shows a variant of FIG. 6.

FIG. 7 shows one embodiment of this invention in which the teat 24 is bonded to the closure 10, or is kept in place in it by a retainer 18. In this version, the screw-threads by which the closure is secured to the body 2 are internal of the body, and external of the closure. Although not shown in the drawing, the interior of the body may be formed with a series of internal teeth intended to mesh with complementary teeth projecting below the screw-threaded skirt 13 of the closure when the closure is nearing the end of its screwing-in motion relative to the body, and after the fit between the closure and body is fluid-tight. The interengaging ratchet teeth play no part in ensuring the fluid-tightness of the seal, but are provided solely to prevent the closure's being unscrewed from the body after the closure has been screwed fully home. As the form and position of the ratchet teeth do not form part of the subject-matter of this invention, they are not described in any further detail herein. This embodiment has the advantage that no amount of inwards force on the wall of the body near or on its thickened rim 3 has any effect on the seal between the closure and the body, and similar force applied to the closure cannot distort the skirt 13 away from the rim 3.

Figure 8:
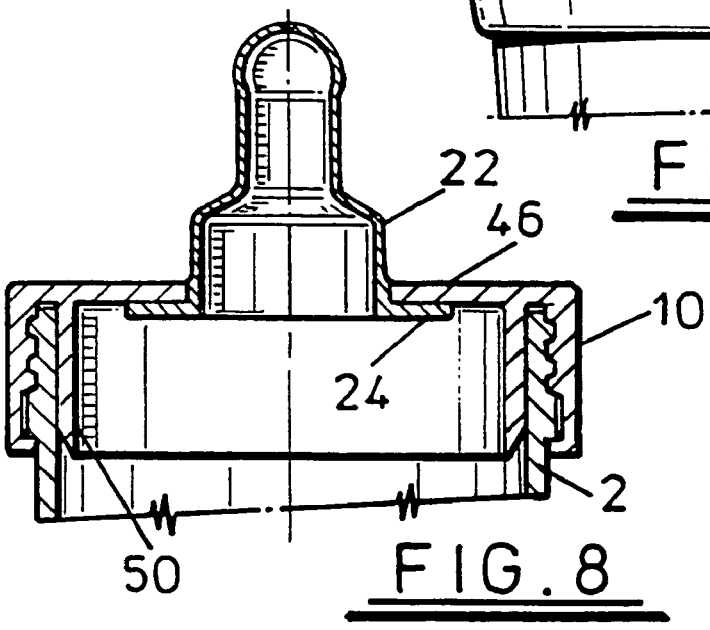
FIG. 8 is a view similar to FIG. 6, showing the presence of an additional skirt on the closure.

FIG. 8 version is similar to that of FIG. 6, except that the resistance to inwards deformation is provided by a close-fitting skirt 50 extending from the end wall 46 against the inner surface of the mouth of the body.

Figure 9:
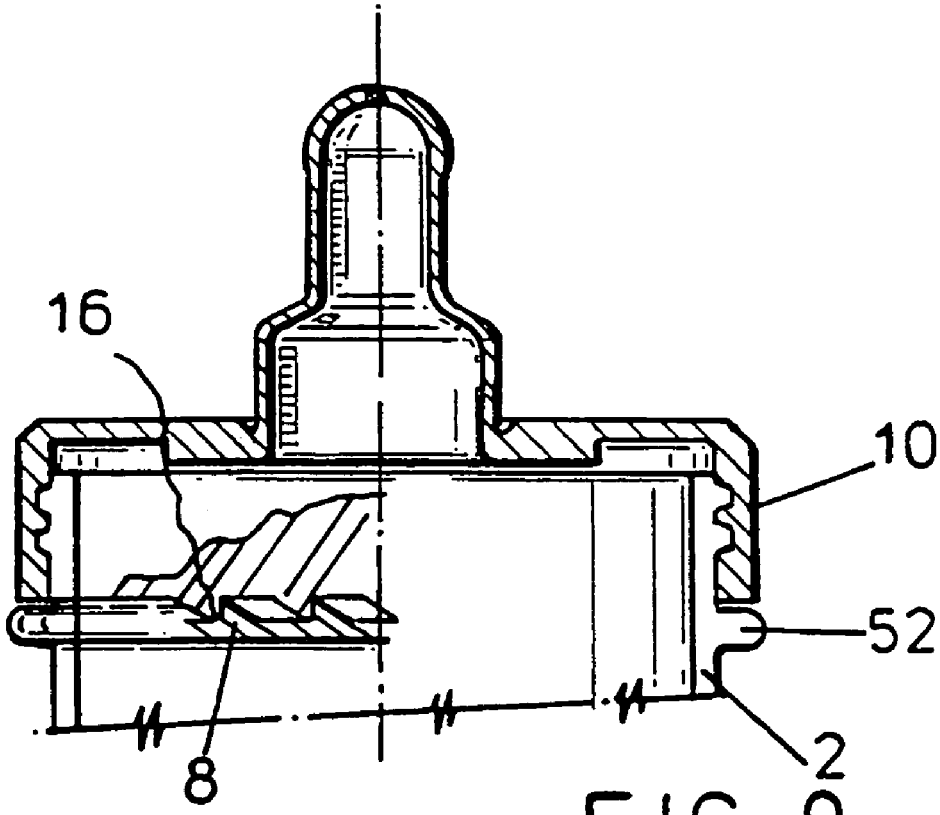
FIG. 9 is a view similar to FIG. 6, showing different method of providing the closure with another form of irremovable coupling.

The embodiment of FIG. 9 is similar to that of FIG. 6, with the difference that a rib 52 is provided on the body 2. That face of the rib 52 facing the closure is formed with an upwardly-directed (as viewed) set of ratchet teeth 8, while the opposing end face of the skirt 14 of the closure is formed with a complementary set of ratchet teeth 16.

Figure 10:
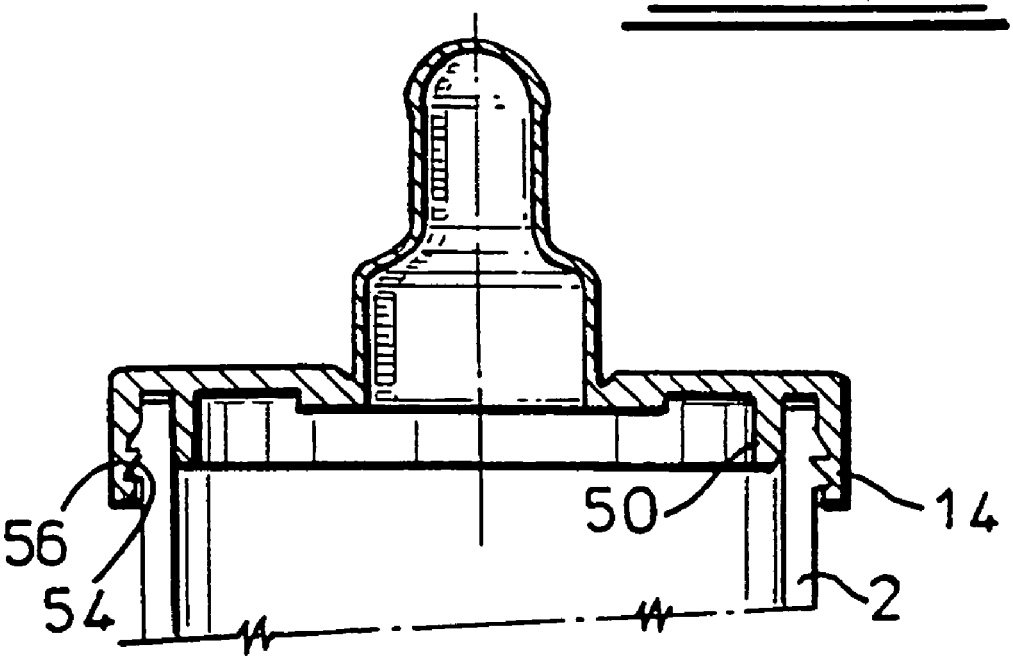
FIG. 10 is a view similar to FIG. 8 showing yet another form of coupling between the closure and body.

In that version shown in FIG. 10, this likewise is similar to that of FIG. 8, except that the one-way coupling between the closure and the body takes for the form of a least one annular rib 54 of triangular cross-section on the body, and a complementary rib or recess 56 on or in the skirt 14. This form of coupling means that the closure has to be pushed on to the body 2, which has the objections mentioned above.

Figure 11:
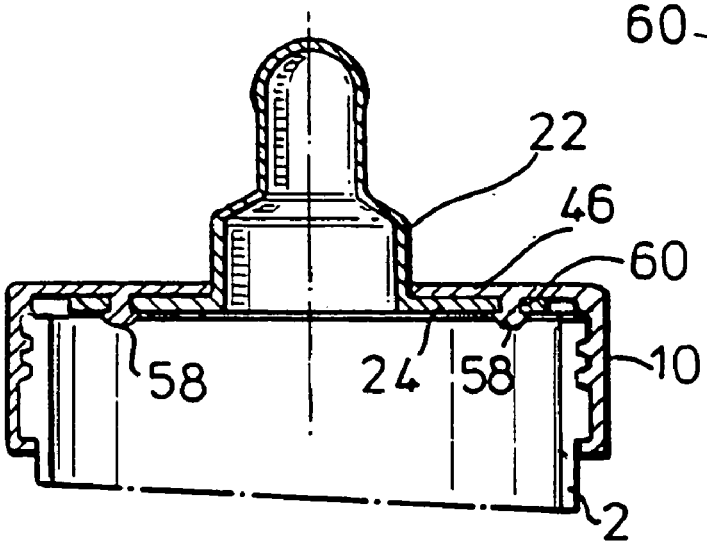
FIG. 11 is a sectional view of another embodiment of combined closure and teat.
Figure 12:
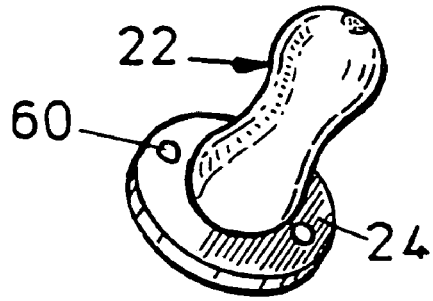
FIG. 12 is a diagrammatic isometric view of a teat modified for use with the FIG. 11 embodiment.

In FIG. 11 version, the teat 22 is also secured directly to the closure 10. The end wall 46 of the closure is formed with at least two inwardly-and axially-directed retainers 58 of 'mushroom' shape. As shown in FIG. 12, the flange 24 of the teat is formed with two openings 60. Preferably the inner diameter of the openings 60 is slightly less than the diameter of the 'stalks' of the retainers 58. The heads of the retainers are sloped or otherwise shaped to facilitate their being pushed into the openings 60 in the teat. When the retainers are fully in place, the walls of the openings 60 are a fluid-tight grip on the stalks, and the heads of the retainers rest against the inner face of the flange 24. There are as many retainers on the closure as are needed to ensure that the contact between the cap and the teat is fluid-tight over the whole area of the flange, to prevent milk etc. from seeping out from between the cap and the teat in use.

Figure 13:
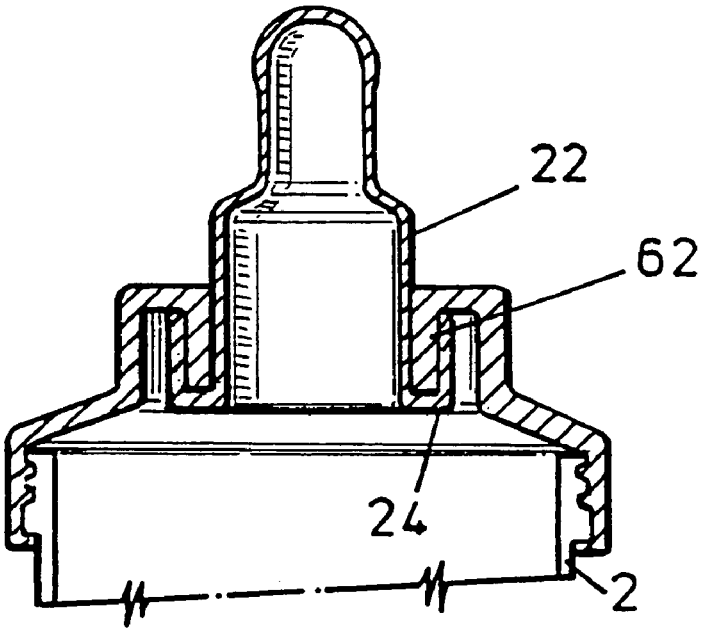
FIG. 13, is a diagrammatic view, part in section, of another form of combined closure and teat.

In that version of the invention shown in FIG. 13 the flange 24 of the teat 22 is convoluted and engages the closure in a fluid-tight manner without the use of auxiliary members, by virtue of its inherent elasticity. The length of its cylindrical flange as formed, prior to its being folded about a cylindrical flange 62 extending from the inner end of the opening in the end wall 46 of the closure, ensures that the teat grips the flange 24 too tightly to be dislodged by pulling on the exposed part of the teat, or by introversion of the teat into the interior of the body.

In all the above embodiments of this invention, the closure is stated as having to be screwed or otherwise coupled on to the body of the bottle by the user after the liquid feed has been put in the body. As an alternative to this, the cooperating screw-threads may be made of such a plastics material, and to have a cross-sectional shape, that permits the cap to be pushed on to the mouth of the body, and only finally tightening the screw. The shape of the interlocking ratchet teeth may also be modified to facilitate their coming into engagement with each other by relative axial movement.

Figure 14:
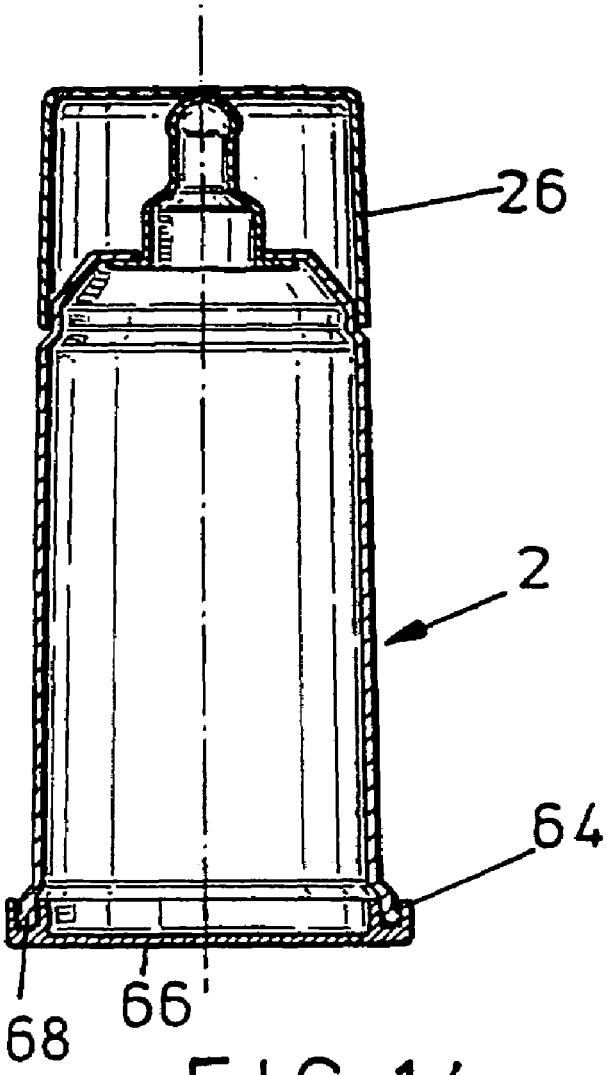
FIG. 14 is a side elevation, part in section, of another embodiment of the invention, having a sealable cap at the end of the body remote from the teat.
Figure 15:
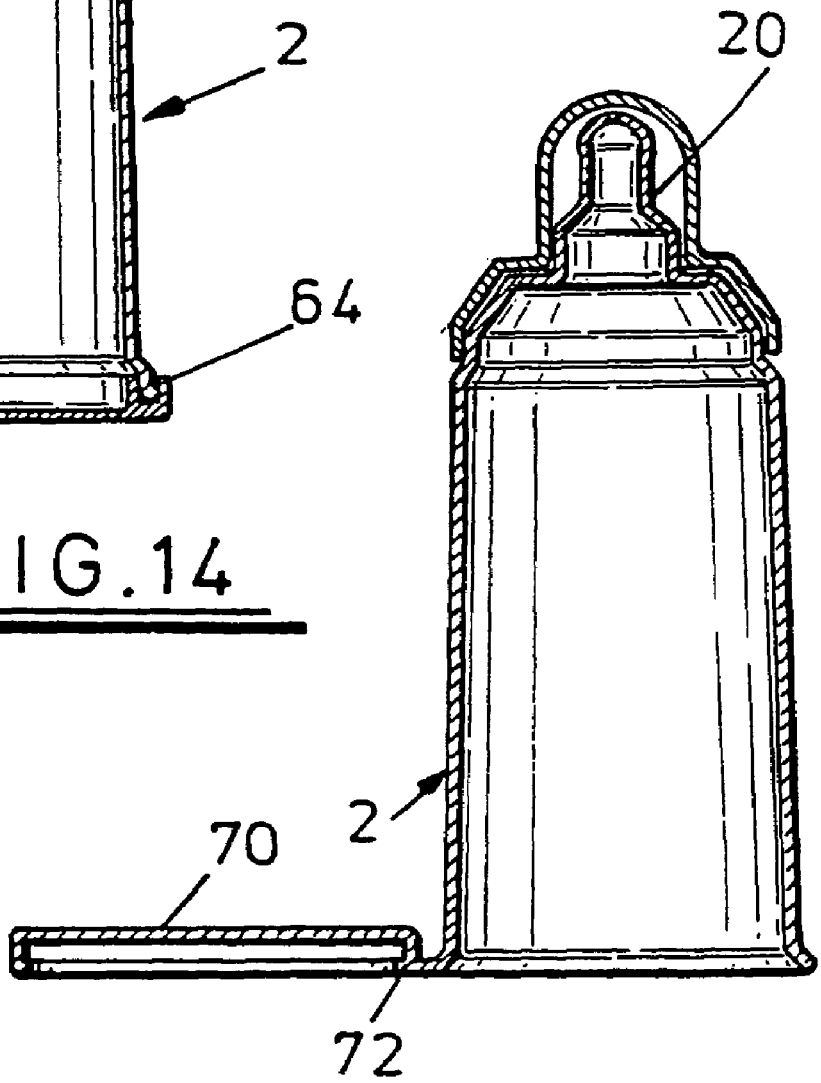
FIG. 15 is a view, similar to FIG. 13, of an alternative form of that embodiment.

In contrast to all the previous embodiments of this invention, in the versions shown in FIGS. 14 and 15, the closure 66 is not used to hold the teat, but is used merely to close the mouth of the body of the bottle. In these versions, the mouth is formed at the end of the body remote from the teat. The mouth may be provided with a beaded edge 64. The closure 66 has in its edge flange 68 an annular recess of cross-section complementary with that of the bead 64. One or other of the two annular walls of the recess is intended to have a line of weakness around its base. In contrast with the other versions of the invention, while the closure 66 is able to be removed fairly easily from the beaded edge, the act of doing so applies such force to the respective wall that it breaks along its line of weakness and becomes detached from the rest of the closure. This ensures that, while the closure may be removed, it cannot be replaced, thus preventing the bottle from being reused as a baby bottle.

In the FIG. 15 version, the closure 70 is moulded in one piece with the rest of the body which, in this version, has the teat 20 also moulded in one piece with the body. The mouth of the opening in the body is slightly flared outwardly, and the closure is formed with an inwardly-directed lip 72. This lip has a line of weakness at its root, so that it too becomes separated from the rest of the closure when force is applied to remove the closure from its grip on the flared mouth of the body.

In all versions of the bottle, and as shown in FIG. 2, the plastics material forming the body may be transparent or translucent, and graduation marks 80 may be moulded or otherwise formed in, or applied to, its walls to act as a guide to the volume of feed in the bottle.

Accordingly it will be seen that this invention provides baby feed bottles which may be made by an aseptic process of plastics material, and which are inherently of inexpensive construction, particularly when made in large numbers.

The invention claimed is:

1. A single use feed bottle made of plastic materials, the bottle including a body for holding a quantity of milk or other liquid, the body having a mouth, which is sealable in a fluid tight manner by means of a screw-threaded closure, a stiffening ring intergral with the body for providing resistance ot inwards deformation of the mouth of the body, the closure and the body having on their inner and outer surfaces respectively mutually cooperating formations to cause the closure to be irremovable from the body after the closure has reached a limit position on the body, in which it forms a fluid-tight fit with the body, wherein a teat and the closure form an integral unit, and a stiffening ring integral with the body for providing resistance to inwards deformation of the mouth of the body, and in which the closure and teat are made of dissimilar plastic materials by a two-stage aseptic process, in one stage of which, one component is formed, and in the other stage of which, the other component is formed in such a way that it becomes bonded to the said one component.

2. A single-use feed bottle made of plastic materials, the bottle including a body for holding a quantity of milk or other liquid, the body having a mouth, which is sealable in a fluid tight manner by means of a screw-threaded closure, a stiffening ring integral with the body for providing resistance to inwards deformation of the mouth of the body, the closure and the body having on their inner and outer surfaces respectively mutually cooperating formations to cause the closure to be irremovable from the body after the closure has reached a limit position on the body, in which it forms a fluid-tight fit with the body, in which a teat having flange of smaller diameter than the inner diameter of the mouth of the body and the closure form an integral unit, and in which the closure and teat are made of dissimilar plastic materials by a two-stage aseptic process, in one stage of which, one component is formed, and in the other stage of which, the other component is formed in such a way that it becomes bonded to the said one component.

3. A method of making a single use feed bottle made of plastic materials, the bottle including a body for holding a quantity of milk or other liquid, the body having a mouth, which is sealable in a fluid tight manner by means of a screw-threaded closure, and a stiffening ring integral with the body for providing resistance to inwards deformation of the mouth of the body, the closure and the body having on their inner and outer surfaces respectively mutually cooperating formations to cause the closure to be irremovable from the body after the closure has reached a limit position on the body, in which it forms a fluid-tight fit with the body, a teat having a flange of smaller diameter than the inner diameter of the mouth of the body, wherein the teat and the closure form an integral unit, the method including the step of moulding the body by aseptic process, wherein the closure and teat are made of dissimilar plastic materials by a two-stage aseptic process, in one state of which, one component is formed, and in the other stage of which, the other component is formed in such a way that it becomes bonded to the said one component.

* * * * *